US008540822B2

(12) United States Patent
Pyo et al.

(10) Patent No.: US 8,540,822 B2
(45) Date of Patent: Sep. 24, 2013

(54) CONTROL METHOD OF A DISHWASHER

(75) Inventors: Joonho Pyo, Seoul (KR); Taehee Lee, Seoul (KR); Simoon Jeon, Seoul (KR); Gapsu Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 491 days.

(21) Appl. No.: 12/827,160

(22) Filed: Jun. 30, 2010

(65) Prior Publication Data

US 2011/0126855 A1 Jun. 2, 2011

(30) Foreign Application Priority Data

Dec. 2, 2009 (KR) ..... 10-2009-0118343

(51) Int. Cl.
*B08B 3/02* (2006.01)

(52) U.S. Cl.
USPC ..... 134/25.2; 134/18

(58) Field of Classification Search
USPC ..... 134/18, 25.2, 42
See application file for complete search history.

(56) References Cited

U.S. PATENT DOCUMENTS

| | | | | |
|---|---|---|---|---|
| 4,217,220 | A | 8/1980 | Egli et al. | |
| 4,754,770 | A | 7/1988 | Fornasari | |
| 5,328,617 | A | 7/1994 | De Haan et al. | |
| 5,450,868 | A | 9/1995 | Young, Jr. | |
| 2006/0237049 | A1 | 10/2006 | Weaver et al. | |
| 2009/0032061 | A1 * | 2/2009 | Beer et al. | 134/18 |

FOREIGN PATENT DOCUMENTS

| | | |
|---|---|---|
| CH | 169630 | 8/1934 |
| DE | 4131914 A1 | 4/1993 |
| DE | 100 46 349 | 3/2002 |
| DE | 10 2004 004 104 | 7/2004 |
| DE | 102007060196 | 6/2009 |
| WO | WO 2007/017330 | 2/2007 |

OTHER PUBLICATIONS

German Office Action issued in German Application No. 10 2010 036 845.8 dated Jun. 20, 2011.
U.S. Office Action issued in U.S. Appl. No. 12/827,201 dated Jun. 5, 2013.
U.S. Office Action issued in U.S. Appl. No. 12/827,242 dated Jun. 18, 2013.
U.S. Office Action issued in U.S. Appl. No. 13/076,890 dated Jun. 5, 2013.

* cited by examiner

*Primary Examiner* — Saeed T Chaudhry
(74) *Attorney, Agent, or Firm* — KED & Associates, LLP

(57) ABSTRACT

A control method of a dishwasher is provided in which a filter is cleaned by controlling an operation of a washing pump. In this control method, washing fluid pumped by the washing pump back flows and is directed to the filter so as to remove foreign materials accumulated in the filter from the filter.

18 Claims, 12 Drawing Sheets

CONTROL METHOD OF A DISHWASHER

CROSS-REFERENCE TO RELATED APPLICATION(S)

The present application claims priority under 35 U.S.C. §119 and 35 U.S.C. §365 to Korean Patent Application No. 10-2009-0118343, filed in Korea on Dec. 2, 2009, which is hereby incorporated by reference in its entirety.

BACKGROUND

1. Field

A control method of a dishwasher is disclosed to clean a filter.

2. Background

Generally, a dishwasher washes dishes by directing washing fluid onto dishes positioned therein. In detail, clean washing water received in a sump is directed onto dishes positioned in the washer by a washing fluid injecting unit, and is then returned to the sump and re-supplied to the washing fluid injecting unit via a filter apparatus in the sump. At the end of the wash cycle, the used washing fluid, together with foreign materials held in the filter apparatus, are drained to the outside of the dishwasher.

Foreign materials accumulated in the filter apparatus during operation may generate flow resistance, thus reducing flow rate of the washing fluid passing through the filter apparatus. This reduced flow rate may impact the washing performance of the dishwasher and overload the washing pump. In addition, foreign materials adhered to the filter are may not be easily removed, which may cause a pungent odor inside the washer due to decay of the foreign materials.

BRIEF DESCRIPTION OF THE DRAWINGS

The embodiments will be described in detail with reference to the following drawings in which like reference numerals refer to like elements wherein.

DETAILED DESCRIPTION

Figure 1:
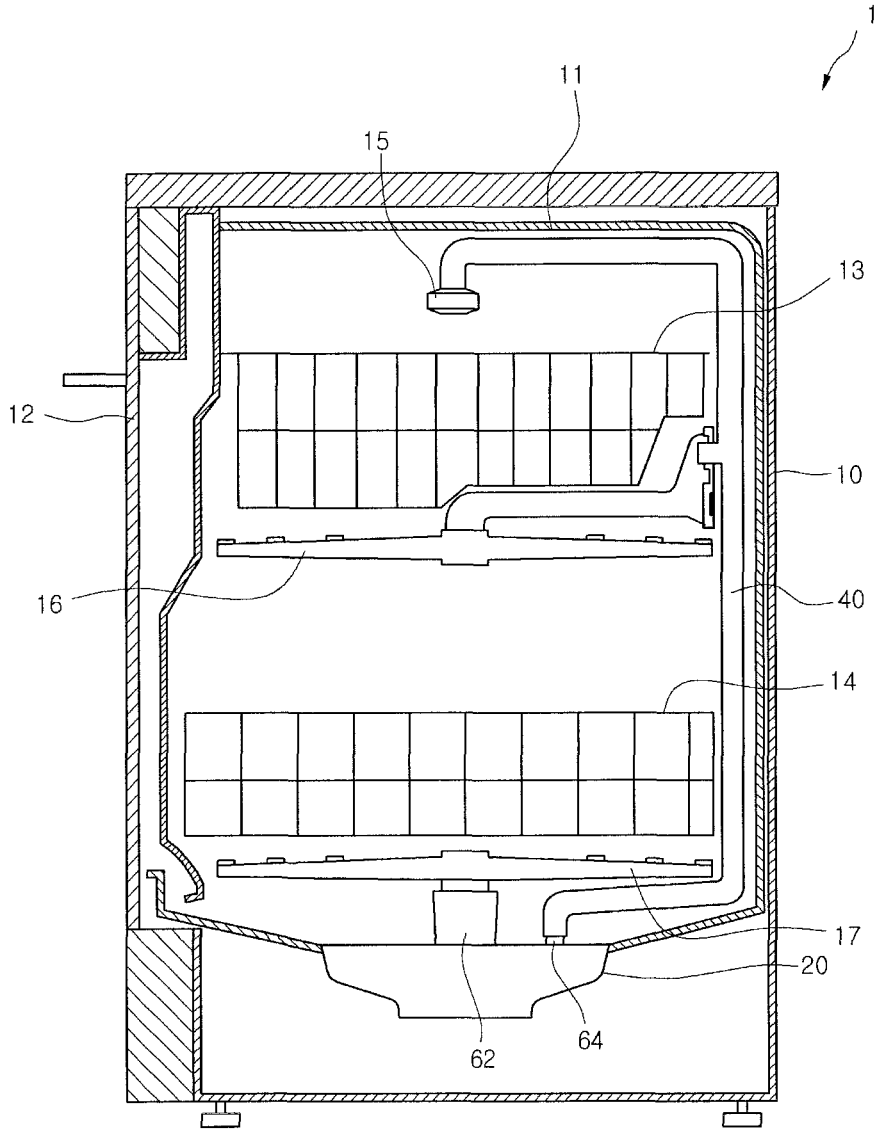
FIG. 1 is a cross-sectional view of a dishwasher according to an embodiment as broadly described herein.

Referring to FIG. 1, a dishwasher 1 according to a first embodiment as broadly described herein may include a case 10, a tub 11 received inside the case 10, a door 12 provided on a front surface of the tub 11 to open and close the washer, and a sump 20 provided at a lower side of the tub 11 to store washing fluid.

A lower rack 14 and an upper rack 13 are provided inside the tub 11 to receive wash items therein. The upper rack 13 is disposed above the lower rack 14 spaced apart by a predetermined distance. The upper rack 13 and the lower rack 14 may be guided by a guide rail (not shown) provided at an inner side of the tub 11, such that they may be drawn in and out through the front of the tub 11. A lower nozzle 17, an upper nozzle 16, and a top nozzle 15 may direct washing fluid from the sump 20 into the inside of the tub 11.

The lower nozzle 17 may be connected to an upper side of the sump 20 to direct washing fluid to the lower portion of the tub 11, onto wash items that are mounted on the lower rack 14. A lower nozzle connecting part 62 may connect the sump 20 to the lower nozzle 17. The upper nozzle 16 may be positioned at a central portion of the washer to direct washing fluid toward the upper rack 13, and the top nozzle 15 may be disposed at a ceiling portion of the tub 11 to direct washing fluid downward.

A washing fluid guide 40 may guide washing fluid toward the upper rack 13 through the top nozzle 15 or the upper nozzle 16. A guide connecting part 64 may connect the sump 20 to the washing fluid guide 40.

Figure 2:
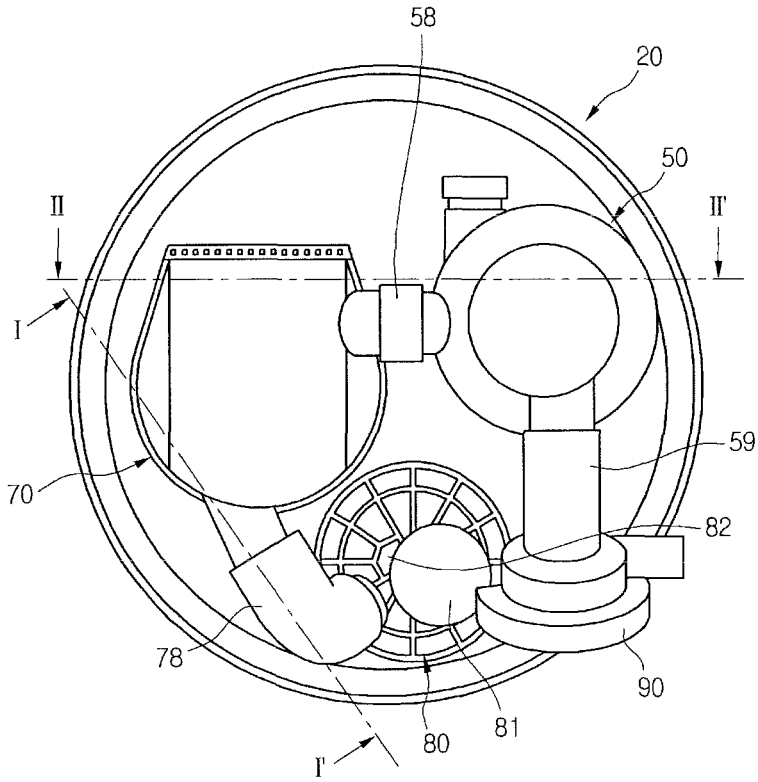
FIG. 2 is a bottom view of a sump of the dishwasher shown in FIG. 1.
Figure 3:
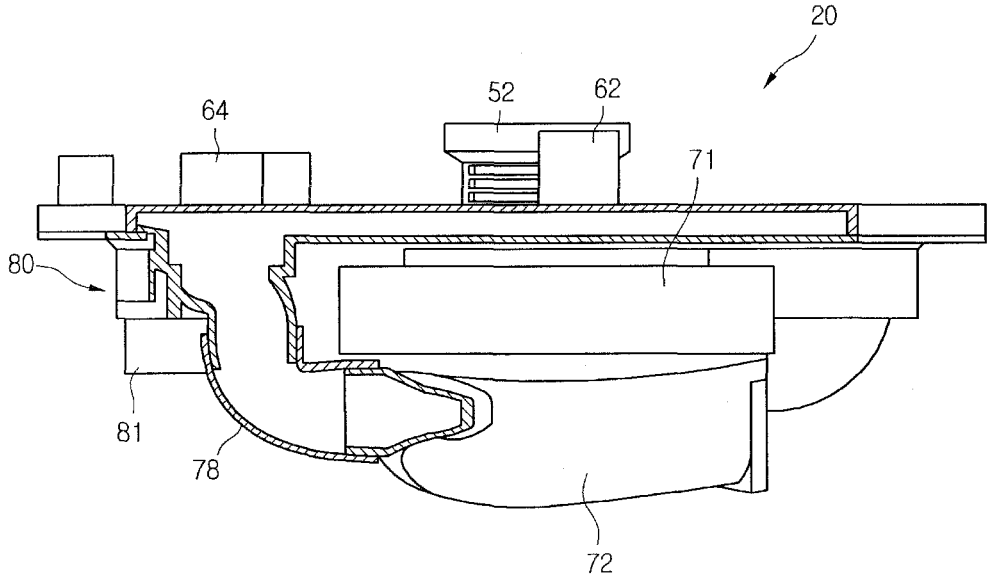
FIG. 3 is a cross-sectional view taken along line I-I' of FIG. 2.
Figure 4:
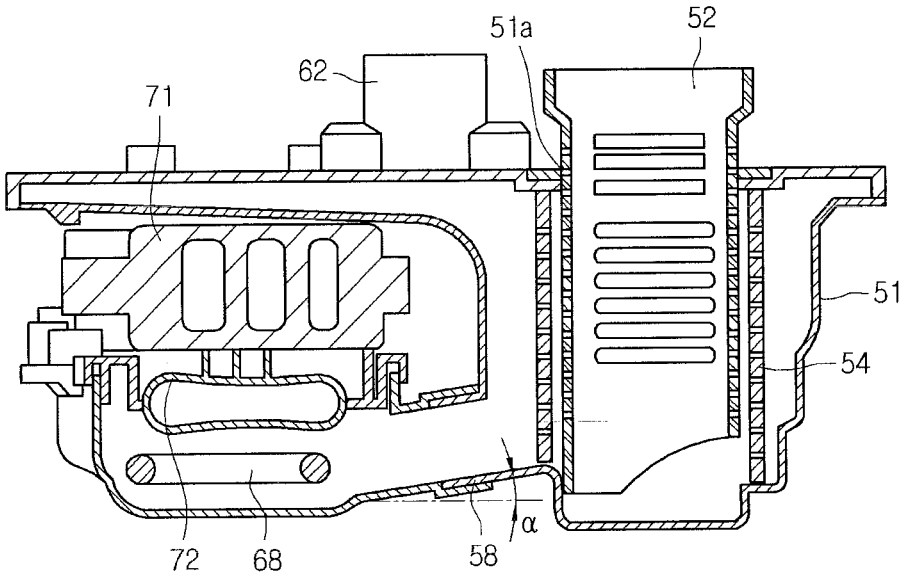
FIG. 4 is a cross-sectional view taken along line II'-II' of FIG. 2.

FIG. 2 is a bottom view of the sump 20, FIG. 3 is a cross-sectional view taken along line I-I' of FIG. 2, and FIG. 4 is a cross-sectional view taken along line II-II' of FIG. 2. The sump 20 may include a filter device 50 that filters foreign materials from the washing fluid, a washing pump 70 that pumps the washing fluid filtered by the filter device 50, and a channel opening and closing device 80 that opens and closes a channel so as to direct washing fluid to the lower nozzle 17 or the washing fluid guide 40.

The filter device 50 may include a first filter 52 that filters relatively large foreign materials from the washing fluid, a second filter 54 that is provided on the outer side of the first filter 52 and filters relatively fine foreign materials from the washing fluid, and a filter housing 51 in which the first filter 52 and the second filter 54 are received. A filter inlet 51*a* may be provided at an upper portion of the filter housing 51 so as to supply washing fluid to the filter device 50. The foreign materials are then filtered from the washing fluid as it passes through the first filter 52 and the second filter 54.

A pump inlet 58 is positioned at side of the lower portion of the filter housing 51 to supply filtered washing fluid to the washing pump 70. The washing fluid stored in the sump 20 may flow to the pump inlet 58 through the filter device 50 due to the suction force of the washing pump 70.

The washing pump 70 includes a motor 71 that provides a driving force and an impeller 72 that rotates in response to the driving force of the motor 71. A pump discharging device 78 discharges washing fluid from the pump 70. Washing fluid is supplied to the impeller 72 through the pump inlet 58 and is discharged through the pump discharging device 78 via the impeller 72. A heater 68 may heat the washing fluid so as to wash dishes with washing fluid heated to a relatively high temperature, thereby improving washing efficiency.

The pump discharging device 78 is connected to the channel opening and closing device 80. The channel opening and closing device 80 may include an opening and closing valve 82 and an opening and closing driver 81 that drives the opening and closing valve 82. Washing fluid supplied to the channel opening and closing device 80 may flow to the lower nozzle connecting part 62 or the guide connecting part 64 through the opening and closing valve 82. In other words, the opening and closing valve 82 directs washing fluid to the lower nozzle 17 via the lower nozzle connecting part 62, and directs washing fluid to the upper nozzle 16 or the top nozzle 15 via the guide connecting part 64.

The washing fluid guide 40 may include separate channels that communicate with the top nozzle 15 or the upper nozzle 16, respectively. For example, the washing fluid guide 40 may include a top nozzle channel and an upper nozzle channel so that washing fluid may be directed to the top nozzle channel or the upper nozzle channel by the opening and closing valve 82. The top nozzle 15, the upper nozzle 16, and the lower nozzle 17 may be selectively opened such that washing may flow through only some of the nozzles 15, 16, and/or 17. Alternatively, all the nozzles 15, 16, and 17 may be opened so that washing fluid flows through all the nozzles 15, 16, and 17.

A draining pump 90 may generate a suction force to drain the washing fluid and a draining device 59 provided between the filter device 50 and the draining pump 90 may drain the washing fluid and the foreign materials. When the draining pump 90 is driven, the washing fluid stored in the sump 20 may be discharged to the outside through the draining device 50 and the draining pump 90 together with the foreign materials captured in the filter device 50.

Washing fluid, such as, for example, clean water, may be supplied from an external source and stored in the sump 20. When the washing pump 70 is driven, the washing fluid may be simultaneously or selectively directed to the top nozzle 15, the upper nozzle 16, and the lower nozzle 17 through the washing pump 70 and the channel opening and closing device 80. The washing fluid may be mixed with a wash agent in the tub 11 to wash the items received in the racks 13 and 14, and may then be stored in the sump 20 again. The foreign materials may be filtered from the washing fluid by the suction force of the washing pump 70 while the washing fluid passes through the filter device 50. Thereafter, the cleaned/filtered washing fluid may be again directed into the tub 11 through the washing pump 70 and the channel opening and closing device 80. The washing process may be repeated several times.

Figure 5:
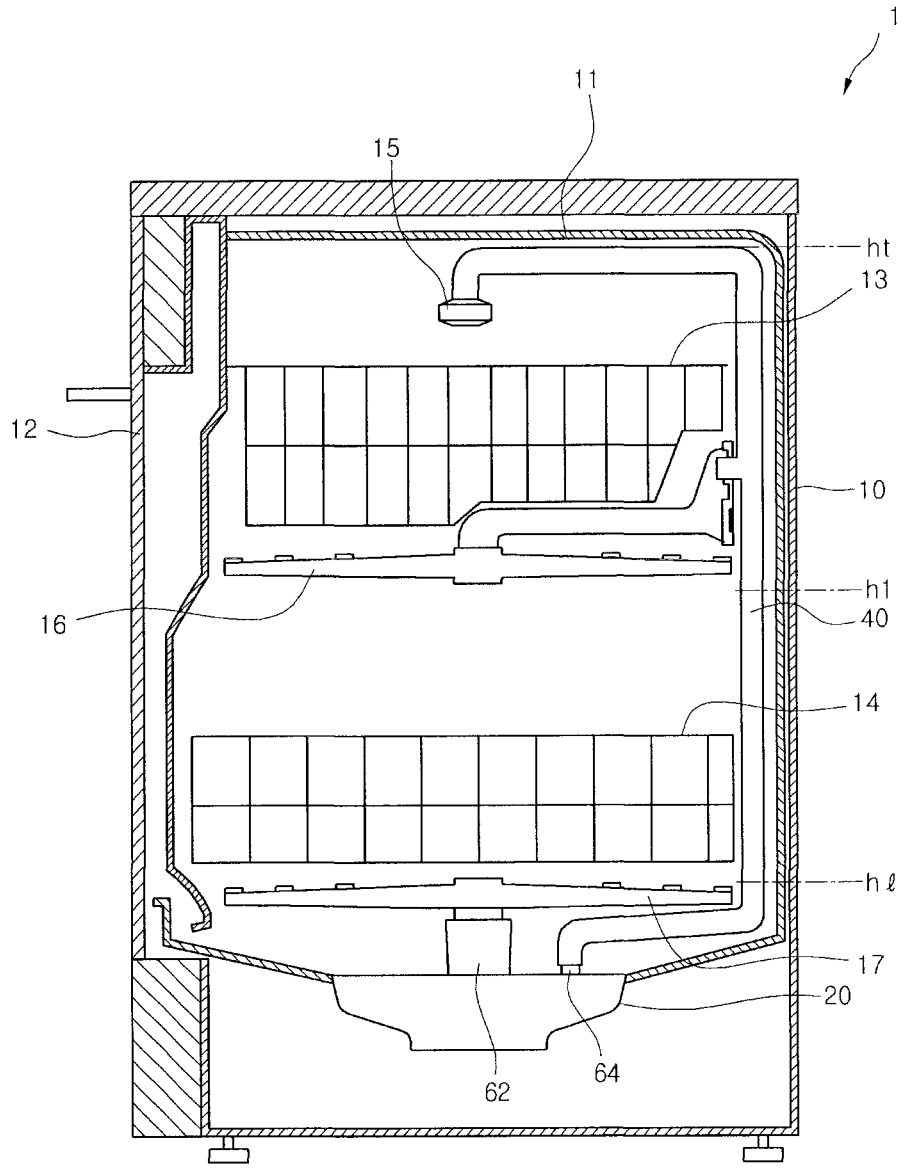
FIG. 5 illustrates operation of washing fluid in the dishwasher shown in FIG. 1.
Figure 6:
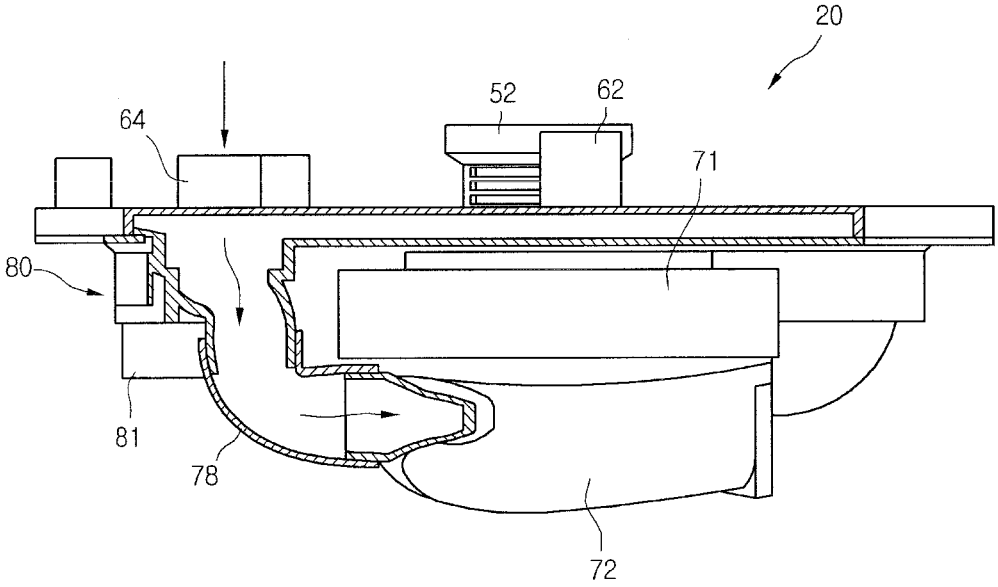
FIGS. 6 and 7 are cross-sectional views of the sump shown in FIGS. 2 and 3, illustrating the operation of washing fluid in the dishwasher shown in FIG. 1.
Figure 7:
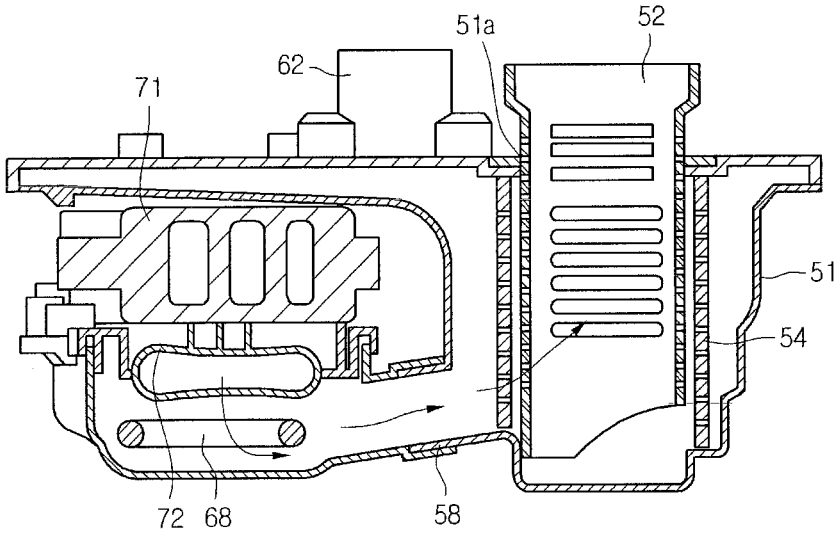

FIG. 5 is a cross-sectional view of the dishwasher shown in FIG. 1, illustrating a flow of washing fluid, and FIGS. 6 and 7 are cross-sectional views of the sump 20, illustrating the flow of washing fluid.

When the washing pump 70 is driven, the washing fluid flows from the sump 20 to the washing fluid guide 40. The washing pump 70 may be turned-off when the washing fluid reaches a predetermined height within the washing fluid guide 40. After the washing pump 70 is turned off, the washing fluid in the washing fluid guide 40 falls downward due to its own potential energy (i.e., its own weight, or gravity) and may be therefore re-supplied to the sump 20. The washing fluid back flows through the channel opening and closing device 80 and the washing pump 70 and may be thus supplied to the filter device 50.

In this process, the washing fluid collides with the filter device 50 as it back flows, at a magnitude of force corresponding to the potential energy of the washing fluid, such that the foreign materials are separated from the filter device 50, in particular, the first and second filters 52 and 54. In other words, the foreign materials accumulated in the filters 52 and 54 may be separated from the surface of the filters 52 and 54 by the collision force of the washing fluid with the filter device 50.

More specifically, the foreign materials attached to the surface of the first and second filters 52 and 54 by the suction force of the washing pump 70 may be separated from the first and second filters 52 and 54 by the collision force of the washing fluid. Hereinafter, the process of cleaning the filter using the back flow force of the washing fluid will be referred to as a "cleaning cycle".

In detail, a height from the bottom surface of the dishwasher 1 to the lower nozzle 17 may be defined as hl, a height from the bottom surface of the dishwasher 1 to the top nozzle 15 may be defined as ht, and a height of the washing fluid rising through washing fluid guide 40 may be h1. Herein, the magnitude of h1 may be greater than hl and less than ht. When h1 is less than hl, the height of the washing fluid is too low, and the potential energy of the washing fluid is relatively small. As a result, the collision force of the washing fluid which may be applied to the filter device 50 is insignificant.

Therefore, the driving force of the washing pump 70 may control the washing fluid so that the washing fluid rises to the level h1 in the washing fluid guide.

In addition, the pump inlet 58 may be inclined, or tilted upward toward the filter device 50 from the washing pump 70. As shown in FIG. 4, the pump inlet 58 may be tilted upward at an angle $\alpha$ from the bottom surface of the sump 20. In this case, the washing fluid flowing to the filter device 50 through the pump inlet 58 impinges on central portions, in a height direction, of the first filter 52 and the second filter 54, such that the foreign materials may be easily separated from the filters 52 and 54.

Figure 8:
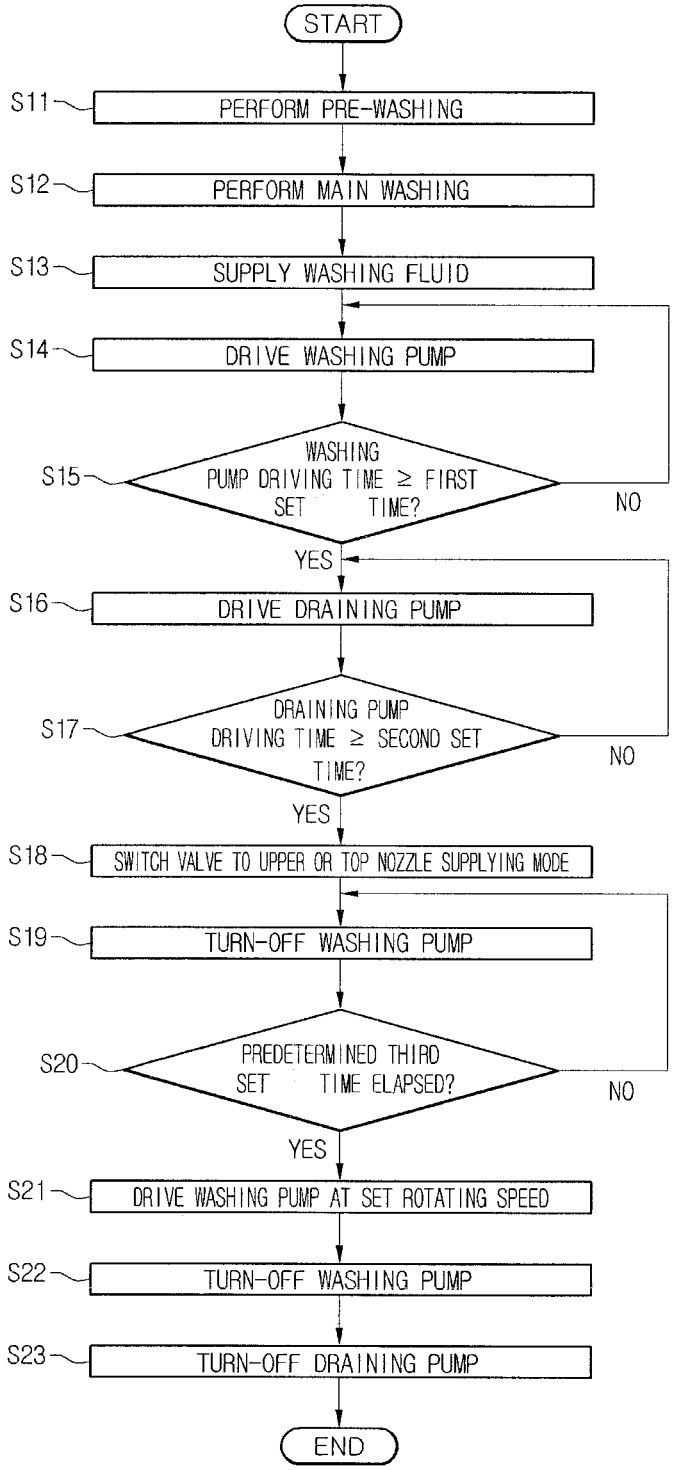
FIG. 8 is a flowchart of a control method of a dishwasher according to an embodiment as broadly described herein.

FIG. 8 is a flowchart of a control method of a dishwasher as embodied and broadly described herein.

The dishwasher 1 may perform a pre-washing cycle followed by a main washing cycle. The pre-washing cycle, which includes removing foreign materials from the wash items with the washing fluid at room temperature (without heating) may include fluid supply, washing, and draining cycles (S11).

The main washing cycle may be performed after the pre-washing cycle. In the main washing cycle, washing fluid, such as, for example, clean water, may be supplied from an external source and mixed with detergent in a detergent box, and may then be in turn supplied to the sump 20 (S12 and S13).

When the washing pump 70 is driven (S14), the washing fluid may be directed from the sump 20 to the washing fluid guide 40, and an elapsed time after the driving of the washing pump 70 is initiated may be counted. If the driving time of the washing pump 70 exceeds a predetermined first set time (S15), which may correspond to a time required to perform a main washing cycle, the draining pump 90 may be driven (S16). When the draining pump 90 is driven, the washing fluid and the foreign materials stored in the sump 20 may be discharged to the outside through the draining device 59. Therefore, as the draining pump 90 is driven, the level of the washing fluid stored in the sump 20 may be lowered.

The elapsed time after the driving of the draining pump 90 is initiated may be counted. It is determined whether the driving time of the draining pump 90 exceeds a predetermined second set time (S17). The second set time may correspond to a particular degree to which the level of the washing fluid stored in the sump 20 is lowered, according to the performance of the draining cycle. Foreign materials separated from the filter device 50 may float to the upper surface of the sump 20 when a cleaning cycle is performed if the level of the washing fluid stored in the sump 20 is too high.

When the driving time of the draining pump 90 exceeds the second set time, the cleaning cycle may be performed. The cleaning cycle may include switching the opening and closing valve 82 so that the washing fluid can flow to the upper nozzle 16 or the top nozzle 15 (S18). In other words, the washing fluid channel may be switched so that the washing fluid rises to a higher position than the lower nozzle 17 and may flow to the upper nozzle 16 or the top nozzle 15 through the guide connecting part 64. At this point, the washing pump 70 may be turned-off (S19).

When the washing pump 70 is turned off, the washing fluid rising along the washing water guide 40 due to the pumping force of the washing pump 70 falls downward due to its own weight and is supplied into the sump 20. The washing fluid supplied into the sump 20 flows to the filter device 50 through the washing pump 70 and strongly collides with the first and second filters 52 and 54 such that the foreign materials attached to the first and second filters 52 and 54 may be separated from the first and second filters 52 and 54. The separated foreign materials are directed to the draining device 59 by the suction force of the draining pump 90 together with the washing fluid so as to be discharged to the outside.

When performing the cleaning cycle, it is determined whether an elapsed time after turning off the washing pump 70 exceeds a predetermined third set time (S20). The third set time may be defined as an amount of time corresponding to a point at which the washing fluid collides with the filter device 50 after turning off the washing pump 70.

When the elapsed time after turning off the washing pump 70 exceeds the third set time, the washing pump 70 may be driven at a predetermined set rotating speed (S21). The set rotating speed may correspond to a driving force that that is capable of raising the washing fluid to a height of h1 in the washing fluid guide 40. The washing pump 70 is turned-off (S22) and the draining pump 90 is turned off (S23) after the washing pump 70 is driven at the set rotating speed.

As described above, driving the washing pump 70 at the set rotating speed (S21) and then turning the washing pump 70 off (S22) causes the cleaning cycle to be performed again, such that the washing fluid back flows from the washing fluid guide 40 to the washing pump 70 and is supplied to the filter device 50. In this process, the foreign materials are separated from the first and second filters 52 and 54 and discharged to the draining unit 59 together with the washing fluid. When the discharge of the foreign materials is complete, the draining pump 90 is turned off (S23).

As described above, the washing pump 70 is first driven at the set rotating speed and then turned off so that the level of the washing fluid is lowered by a predetermined height so that the cleaning mode may be performed and the foreign materials separated from the filter device 50 may be easily discharged.

In the embodiment shown in FIG. 8, the cleaning cycle is performed twice. However, in alternative embodiments, the cleaning cycle may be performed three times or more based on an operating time of the draining pump 90. For example, in the embodiment shown in FIG. 8, the cleaning cycle is performed in the main washing cycle. However, the cleaning cycle may be performed in the pre-washing cycle.

Figure 9:
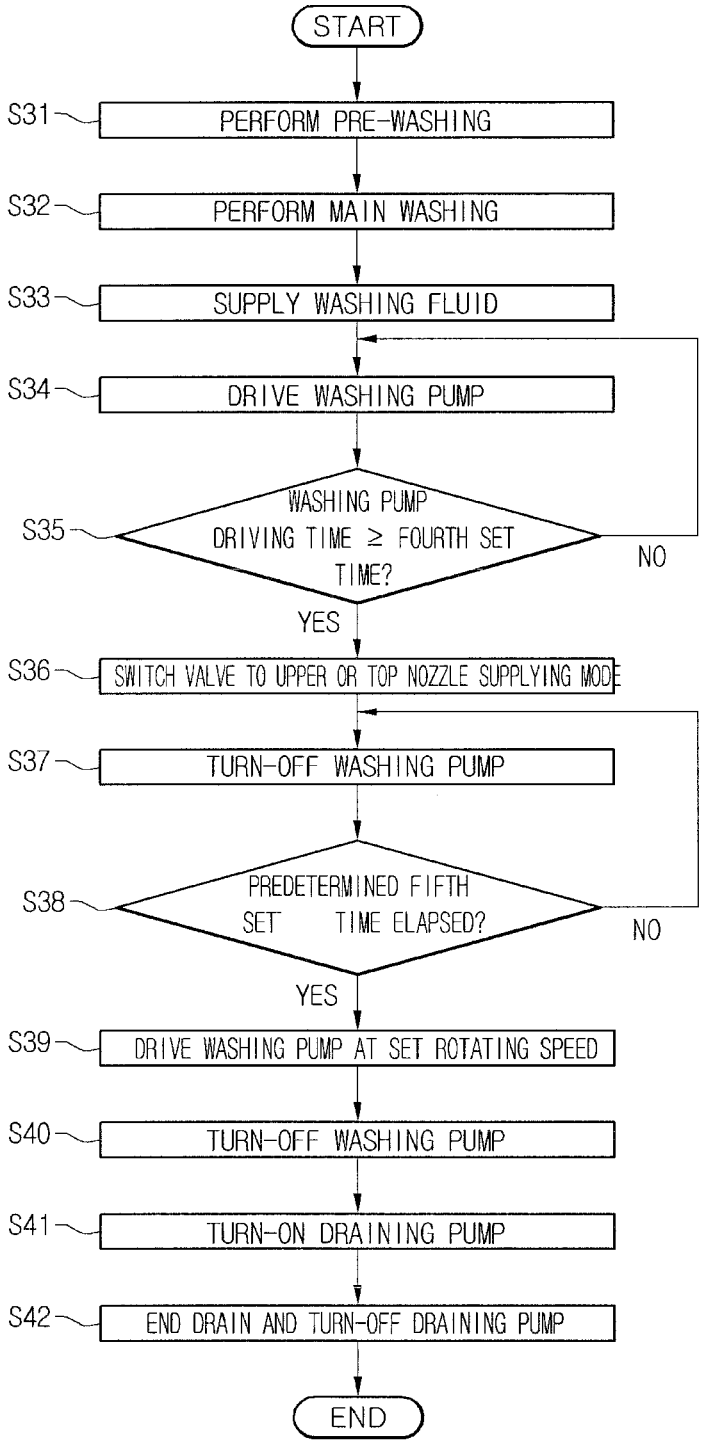
FIG. 9 is a flowchart of a control method of a dishwasher according to another embodiment as broadly described herein.

In a control method of a dishwasher according to the embodiment shown in FIG. 9, the dishwasher 1 may perform a pre-washing cycle (S31) followed by a main washing cycle (S32). In the main washing cycle, the washing pump 70 is driven (S34) after washing fluid is supplied (S33) such that the washing fluid may be injected into the tub 11. It is determined whether the driving time of the washing pump 70 exceeds a fourth set time (S35). The fourth set time may be defined as a time at which foreign materials are accumulated in the filter device 50 to a certain degree while performing the washing cycle. When the driving time of the washing pump 70 exceeds the fourth set time, the cleaning cycle is performed.

Performing the cleaning cycle includes switching the opening and closing valve 82 so that the washing fluid may flow to the upper nozzle 16 or the top nozzle 15 (S36). In other words, the washing fluid channel may be switched so that the washing fluid may rise to a higher position than the lower nozzle 17 and may flow to the upper nozzle 16 or the top nozzle 15 through the guide connecting part 64. The washing pump 70 may then be turned-off (S37).

When the washing pump 70 is turned off, the washing fluid rising along the washing fluid guide 40 due to the pumping force of the washing pump 70 falls downward due to its own weight and is supplied into the sump 20. The washing fluid supplied into the sump 20 flows to the filter device 50 through the washing pump 70 and strongly collides with the first and second filters 52 and 54 such that the foreign materials attached to the first and second filters 52 and 54 may be separated from the first and second filters 52 and 54. This prevents foreign materials from sticking or adhering to the surface of the filter during the washing cycle.

When performing the cleaning cycle, it is determined whether an elapsed time after turning off of the washing pump 70 exceeds a predetermined fifth set time (S38). The fifth set time may be defined as a point in time at which, after turning off the washing pump 70, the washing fluid collides with the filter device 50.

When the elapsed time after turning off the washing pump 70 exceeds the fifth set time, the washing pump 70 is driven at a predetermined set rotating speed (S39). The set rotating speed may correspond to a driving force that is capable of raising the washing fluid to a height of h1 in the washing fluid guide 40. The washing pump 70 may be turned-off (S40) after being driven at the set rotating speed to perform the cleaning cycle again. This causes the washing fluid to back flow through the washing fluid guide 40 to the washing pump 70, and to collide with the filters 52 and 54 again. In this process, the foreign materials adhered to the first and second filters 52 and 54 may be separated from the first and second filters 52 and 54.

When the cleaning cycle is completed, the draining pump 90 is driven (S41) so that washing fluid may be discharged to the outside through the draining device 59 together with the foreign materials separated from the first and second filters 52 and 54. When the draining cycle is completed, the draining pump 90 is turned-off (S42), and the main washing cycle is completed.

Figure 10:
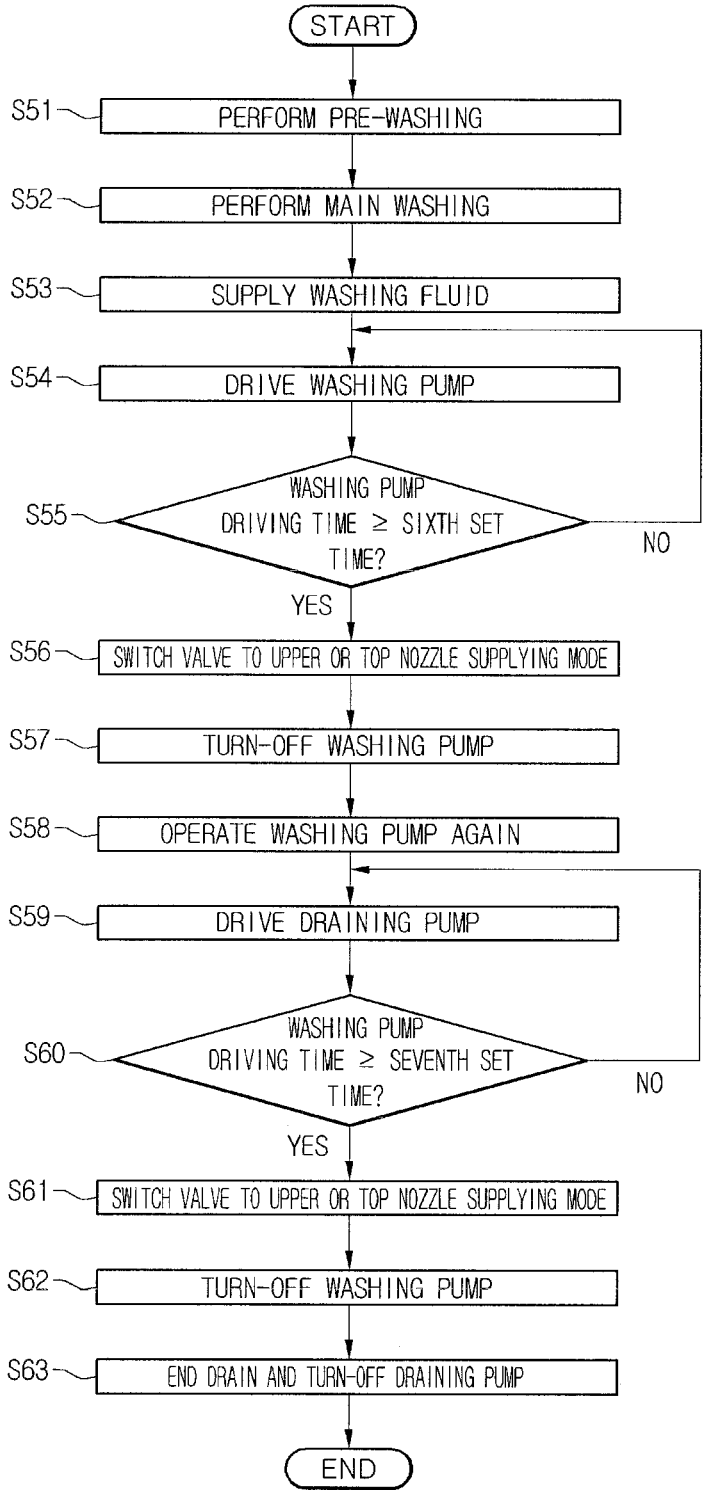
FIG. 10 is a flowchart of a control method of a dishwasher according to another embodiment as broadly described herein.

FIG. 10 is a flowchart of a control method of a dishwasher according to another embodiment as broadly described herein. Steps S51 to S54 shown in FIG. 10 are essentially the same as steps S31 to S34 shown in FIG. 9 and therefore, a detailed description thereof will be omitted.

After the washing pump 70 is driven (S54), it is determined whether the driving time of the washing pump 70 exceeds a sixth set time (S55). The sixth set time may be defined as a point at which the foreign materials are accumulated to a certain degree in the filter device 50 during the washing cycle.

When the driving time of the washing pump 70 exceeds the sixth set time, the opening and closing valve 82 is switched (S56) so that the washing pump 70 may be switched to a cleaning mode, that is, a mode that supplies washing fluid to the upper nozzle 16 or the top nozzle 15. When the opening and closing valve 82 is switched to the upper or top nozzle mode, the washing fluid rises along the washing fluid guide 40 so that the washing fluid rises to a higher position than the lower nozzle 17. The washing pump 70 may then be turned-off (S57).

The washing fluid rising along the washing fluid guide 40 due to the pumping force of the washing pump 70 falls downward due to its own weight and is supplied into the sump 20. The washing fluid supplied into the sump 20 flows to the filter device 50 through the washing pump 70 and strongly collides with the first and second filters 52 and 54 such that the foreign materials attached to the first and second filters 52 and 54 may be separated from the first and second filters 52 and 54.

After the washing pump 70 is turned-off to perform the cleaning of the first and second filters 52 and 54, the washing pump 70 is then re-started (S58) so that washing fluid may be injected from the sump 20 into the tub 11.

The draining pump 90 is then driven (S59). When the draining pump 90 is driven, the washing fluid and the foreign materials stored in the sump 20 may be discharged to the outside through the draining device 59.

An elapsed time after the driving of the draining pump 90 may be counted. It is determined whether the driving time of the draining pump 90 exceeds a predetermined seventh set time (S60). The seventh set time may correspond to a degree to which a level of the washing fluid stored in the sump 20 is lowered, according to the performance of the draining cycle.

When the driving time of the washing pump 90 exceeds the seventh set time, the opening and closing valve 82 may be switched (S61) so that the washing fluid may flow to the upper nozzle 16 or the top nozzle 15. The washing pump 70 may then be turned-off (S62). At this time, the washing fluid rising along the washing fluid guide 40 due to the pumping force of the washing pump 70 falls downward due to its own weight such that the washing fluid may be supplied into the sump 20.

The washing fluid supplied into the sump 20 flows to the filter device 50 through the washing pump 70 and strongly collides with the first and second filters 52 and 54 such that the foreign materials attached to the first and second filters 52 and 54 may be separated from the first and second filters 52 and 54. The separated foreign materials are directed to the draining device 59 due to the suction force of the draining pump 90 together with the washing fluid to be discharged to the outside. When the discharge of the foreign materials is completed, the draining pump 90 is turned off (S63).

As described above, the draining pump 90 is driven before the driving of the washing pump 70 stops so that the level of the washing fluid may be lowered by a predetermined height. In this state, the filter cleaning cycle is performed so that the foreign materials may be easily discharged.

Figure 11:
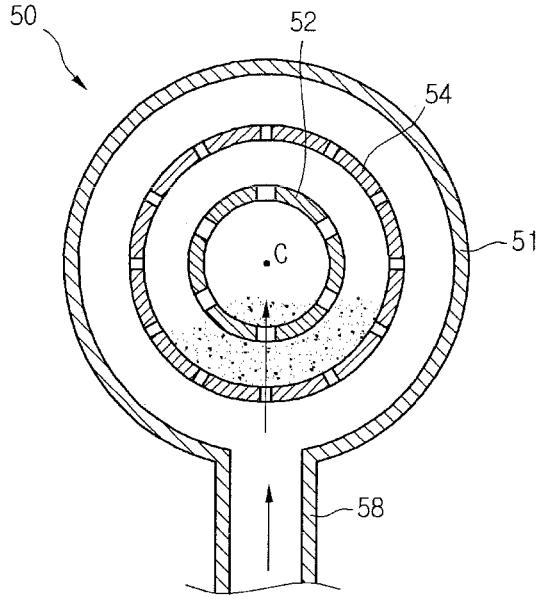
FIG. 11 is a cross-sectional view of a filter housing of a dishwasher according to an embodiment as broadly described herein.
Figure 12:
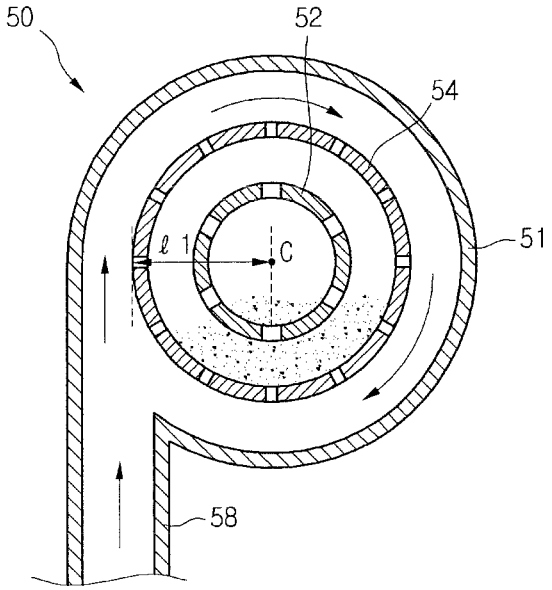
FIG. 12 is a cross-sectional view of a filter housing of a dishwasher according to another embodiment as broadly described herein.

FIGS. 11 and 12 are cross-sectional views of filter housings of a dishwasher as embodied and broadly described herein.

Referring to FIG. 11, the pump inlet 58 is provided at one side of the filter housing 51 to supply washing fluid to the washing pump 70. In this embodiment, the filter housing 51 may have an approximately cylindrical shape so as to receive the first and second filters 52 and 54 therein. In the above-mentioned cleaning cycle, the washing fluid, which back flows into the filter device 50 from the washing pump 70, may flow to the center C of the filter housing 51 through the pump inlet 58. The center C may correspond to the center of the first filter 52 and the second filter 54, which may be concentrically aligned. In other words, in this embodiment, the pump inlet 58 may be oriented toward the center C of the filter housing 51 from the washing pump 70. When so configured, washing fluid supplied from the pump inlet 58 to the filter device 50 collides with the first and second filters 52 and 54, and foreign materials accumulated in the first and second filters 52 and 54 may be separated from the first and second filters 52 and 54.

Alternatively, as shown in FIG. 12, the pump inlet 58 may extend in a tangential direction of the filter housing 51. In the cleaning cycle, the washing fluid, which back flows from the pump inlet 58 which is spaced by a distance l1 from the center C of the filter housing 51, flows inside the filter housing 51 tangentially. The washing fluid flowing along the inner circumferential surface of the filter housing 51 removes foreign materials accumulated in the first and second filters 52 and 54 from the first and second filters 52 and 54, thus preventing the first and second filters 52 and 54 from clogging due to the foreign materials.

A control method of a dishwasher may prevent a filter from being clogged by foreign materials by controlling an operation of a washing pump and a draining pump.

A control method of a dishwasher may clean foreign materials accumulated in a filter using washing water.

A control method of a dishwasher including a washing space that includes a first injecting nozzle and a second injecting nozzle having a higher height than that of the first injecting nozzle, a sump that is supplied with washing water injected into the washing space and passes the washing water to a filter, a washing pump that pressurizes the washing water supplied from the sump, a draining pump that is communicated with the sump and discharges the washing water in the sump to the outside, a channel controller that controls a channel to supply the washing water to the first injecting nozzle and the second injecting nozzle from the washing pump, and a washing water guide whose at least a part is adjacently disposed on one side of the washing space, as embodied and broadly described herein may include driving the washing pump; setting the channel controller to move the washing water to the second injecting nozzle direction; raising the washing water in the washing water guide; stopping the driving of the washing pump; back flowing the washing water to the washing pump from the washing water guide; and separating foreign materials attached to the filter by colliding the back flowing washing water with the filter.

A control method of a dishwasher including a washing space that includes a plurality of injecting nozzles, a sump that is supplied with washing water injected into the washing space and passes the washing water to a filter a washing pump that pressurizes the washing water supplied from the sump, a draining pump that is communicated with the sump and discharges the washing water in the sump to the outside, and a washing water guide that guides the washing water discharged from the washing pump to arrive at the injecting nozzle, in accordance with another embodiment as broadly described herein may include injecting the washing water into the washing space by driving the washing pump; driving the draining pump when the driving time of the washing pump elapses a first setting time; interrupting power supplied to the washing pump when the driving time of the draining pump elapses a second setting time; and separating foreign materials attached to the filter from the filter by back flowing the washing water to the sump from the washing water guide.

A control method of a dishwasher including a washing space that includes a first injecting nozzle and a second injecting nozzle having a higher height than that of the first injecting nozzle, a sump that is supplied with washing water injected into the washing space and passes the washing water to a filter, a washing pump that pressurizes the washing water supplied from the sump, a draining pump that is communicated with the sump and discharges the washing water in the sump to the outside, a channel controller that controls a channel to supply the washing water to the first injecting nozzle and the second injecting nozzle from the washing pump, and a washing water guide whose at least a part is adjacently disposed on one side of the washing space, in accordance with another embodiment as broadly described herein may include driving the washing pump; stopping the driving of the washing pump in the state where the driving time of the washing pump elapses a first setting time and the setting height of the washing water rises in the washing water guide; back flowing the washing water, which passes through the sump, to the sump; and separating foreign materials attached to the filter from the filter by the back flowing washing water.

In a control method of a dishwasher as embodied and broadly described herein, the washing water pumped by the washing pump may be strongly applied to the filter by the back flowing, thereby making it possible to separate the foreign materials from the filter.

In addition, the filter may be cleaned by controlling the operation of the washing pump or the draining pump without needing a separate filter cleaning unit, thereby making it possible to increase the cleaning efficiency of the filter at low cost.

Further, the foreign materials existing in the filter may be effectively cleaned and the flowing of the washing water is smoothly performed, thereby making it possible to improve the washing performance of the dishes.

Moreover, the foreign materials are removed from the filter surface to prevent the filter from clogging, thereby making it possible to improve the filtering performance of the washing water.

Further, the foreign materials separated from the filter may be discharged to the outside of the dishwasher in a draining cycle, thereby making it possible to prevent the occurrence of a bad smell due to the decay of the foreign materials.

Also, the washing performance and resulting cleanliness level of the dishes is improved and the foreign materials may be easily discharged, thereby making it possible to improve the reliability of the product.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control method of a dishwasher, the method comprising:

driving a washing pump to pump washing fluid to direct the washing fluid in a sump into a washing fluid guide;

driving a draining pump before stopping pumping of the washing fluid, driving the draining pump comprising:

initiating driving the draining pump after a first set time has elapsed since initiating the pumping of the washing fluid; and driving the draining pump to adjust a level of the washing fluid stored in the sump while continuing to pump the washing fluid;

stopping the driving of the washing pump after a second set time has elapsed since initiating the driving of the draining pump to generate a back flow of washing fluid in the washing fluid guide to the washing pump; and allowing the back flow of washing fluid to splash onto a filter to separate particles from the filter.

2. The method of claim 1, further comprising, after a third set time has elapsed after stopping the driving of the washing pump and impinging the back flow of washing fluid onto the filter, driving the washing pump to a set rotating speed that is less than a maximum rotating speed.

3. The method of claim 2, further comprising stopping the driving of the washing pump when the washing pump reaches the set rotating speed, and thereafter stopping the driving of the draining pump.

4. The method of claim 1, further comprising setting a channel controller and stopping a driving of a washing pump so as to stop the pressurization of the washing fluid, comprising switching a valve in the washing fluid guide to an upper nozzle supply mode and stopping the pressurization of the washing fluid by stopping a driving of the washing pump after a fourth set time has elapsed since initiating the driving of the washing pump.

5. The method of claim 4, further comprising:

after a fifth set time has elapsed since stopping the driving of the washing pump, driving the washing pump to a set rotating speed that is less than a maximum rotating speed; and stopping the driving of the washing pump when the washing pump reaches the set rotating speed, and thereafter driving the draining pump.

6. The method of claim 1, further comprising setting a channel controller and stopping the pressurization of the washing fluid by stopping a driving of a washing pump, and switching a valve in the washing fluid guide to an upper nozzle supply mode and stopping the driving of the washing pump after a sixth set time has elapsed since initiating the driving of the washing pump.

7. The method of claim 6, further comprising:

driving the washing pump again and driving the draining pump; and after a seventh set time has elapsed since driving the washing pump again, re-setting the channel controller to the first direction and stopping the driving of the washing pump, and thereafter stopping the driving of the draining pump.

8. The method of claim 1, wherein a pump inlet is provided between the filter and a washing pump provided at the sump, and wherein the pump inlet tilts upward toward the filter from the washing pump.

9. The method of claim 8, wherein allowing the back flowing washing fluid to splash onto the filter comprises directing the washing fluid to a center of the filter through the pump inlet.

10. The method of claim 8, wherein allowing the back flowing washing fluid to splash onto the filter comprises directing the washing fluid in a direction away from a center of the filter.

11. The method of claim 1, wherein allowing the back flowing washing fluid to splash onto the filter further comprises discharging the washing fluid and the particles separated from the filter.

12. A method of controlling a dishwasher, the method comprising:

initiating a driving of a washing pump so as to direct washing fluid into a washing space;

when a first set time has elapsed since initiating the driving of the washing pump, initiating a driving of a draining pump;

when a second set time has elapsed since initiating the driving of the draining pump, interrupting power supplied to the washing pump;

directing a back flow of washing fluid from a washing fluid guide to a filter provided in a sump so as to dislodge particles from the filter;

switching a valve in the washing fluid guide to an upper or top nozzle mode when the second set time has elapsed, and wherein directing a back flow of washing fluid from a washing fluid guide to a filter comprises:

providing washing fluid up to a predetermined level in the washing fluid guide in response to a pumping force generated by the washing pump; and allowing the washing fluid accumulated in the washing fluid guide to flow back to the washing pump and to the filter in the sump when power to the washing pump is interrupted and the pumping force of the washing pump is no longer generated.

13. The method of claim 12, further comprising, after a third set time has elapsed after interrupting power supplied to the washing pump, re-supplying power to the washing pump to drive the washing pump to a set rotating speed that is less than a maximum rotating speed.

14. The method of claim 13, further comprising interrupting power to the washing pump when the washing pump reaches the set rotating speed, and thereafter interrupting power supplied to the draining pump.

15. The method of claim 12, further comprising switching a valve in the washing fluid guide to an upper nozzle supply mode when interrupting power supplied to the washing pump.

16. The method of claim 15, further comprising:

after interrupting power to the washing pump and directing the back flow of washing fluid onto the filter, re-supplying power to the washing pump to drive the washing pump to a set rotating speed that is less than a maximum rotating speed; and interrupting power supplied to the washing pump when the washing pump reaches the set rotating speed, and thereafter supplying power to the draining pump.

17. The method of claim 12, wherein interrupting power supplied to the washing pump comprises interrupting power supplied to the washing pump when level of washing fluid in the washing water guide is greater than a height of a lowermost nozzle of a plurality of nozzles positioned in the washing space.

18. A method of controlling a dishwasher, the method comprising:

performing a pre-washing cycle;

performing a main washing cycle; and performing a filter cleaning cycle at least once during the pre-washing cycle and at least once during the main washing cycle, wherein performing a filter cleaning cycle comprises:

setting a valve positioned in a washing fluid guide in a first direction and supplying washing fluid from a sump into the washing fluid guide to a predetermined level in response to a pumping force generated by a washing pump;

stopping a supply of power to the washing pump to cause the washing fluid accumulated in the washing fluid guide flow back to the washing pump; and impinging the back flow of washing fluid onto a filter provided in the sump so as to separate particles from the filter.

* * * * *